United States Patent [19]

Cole

[11] 4,171,019

[45] Oct. 16, 1979

[54] APPARATUS AND METHOD FOR RE-ENTERING AND CEMENTING AN UNDERWATER WELL

[75] Inventor: Frank Cole, Houston, Tex.

[73] Assignee: Davis-Lynch, Inc., Houston, Tex.

[21] Appl. No.: 868,823

[22] Filed: Jan. 12, 1978

[51] Int. Cl.[2] ..... E21B 7/12

[52] U.S. Cl. ..... 166/341; 166/328; 175/5

[58] Field of Search ..... 166/0.5, 0.6, 113, 115, 166/250, 254, 255, 285, 290, 327, 328, 329

[56] References Cited

U.S. PATENT DOCUMENTS

| | | | |
|---|---|---|---|
| 2,212,086 | 8/1940 | Thornhill | 166/328 X |
| 2,320,670 | 6/1943 | Scaramucci | 166/328 |
| 2,825,412 | 3/1958 | Standridge | 166/328 |
| 3,199,613 | 8/1965 | Malott et al. | 175/5 |
| 3,269,463 | 8/1966 | Page, Jr. | 166/329 |
| 3,332,497 | 7/1967 | Page, Jr. | 166/329 |
| 3,584,645 | 6/1971 | Radig | 166/329 X |
| 3,616,850 | 11/1971 | Scott | 166/155 |
| 3,744,561 | 7/1973 | Shatto et al. | 166/0.5 |
| 3,788,396 | 1/1974 | Shatto et al. | 166/0.5 |
| 3,850,194 | 11/1974 | Brown | 166/329 X |
| 4,031,544 | 6/1977 | Lapetina | 175/5 |

*Primary Examiner*—Ernest R. Purser
*Assistant Examiner*—Richard E. Favreau

[57] ABSTRACT

A re-entry cementing float shoe for use with sonar/TV underwater guide systems is a short inner and outer cylindrical housing members in concentric spaced relationship forming an annular space therebetween with a cementing core filling said annular space, said inner housing has its top below the top of the outer housing, the upper inner surface of the cement forming a taperal lining cone, the bottom of the cone ending at the top of the inner housing and the top of the cement cone ending at the inner surface of the outer housing below an inner top portion of the outer housing, said portion having an attachment means for accepting and attaching to a casing pipe. The top inner surface of the inner housing has an inner diameter capable of receiving and holding a cementing pipe string, followed by a first circular shoulder means sloping inwardly and downwardly, a plurality of threads capable of receiving and holding a latch plug are on the inner surface of the inner housing below the first shoulder means, below the threads are a locating means and an anti-rotation and/or orientation means for a sonar/TV locating camera, below said locating means and said anti-rotation means is a second circular shoulder means sloping outwardly and downwardly adapted to sealingly receive a ball valve. Below said second shoulder is a side pocket valve housing with a ball valve, the valve housing extends downwardly and outwardly from the bore of the inner housing to a depth at least equal to the diameter of the ball valve, the diameter of the ball valve being such that it will when in contact with the second shoulder means form a seal.

9 Claims, 4 Drawing Figures

FIG. 2

APPARATUS AND METHOD FOR RE-ENTERING AND CEMENTING AN UNDERWATER WELL

A method of entering an underwater well bore or hole and cementing within said hole which involves lowering the shoe described above attached to a casing to within the vicinity of the well bore, stabbing a cementing pipe string into the top of the shoe, lowering a sonar/TV guiding device through the cementing and finding and entering the well by use of the guiding device, withdrawing the guiding device, lowering the casing with shoe to the desired level within the well or bore hole, pumping a desired amount of cement into the cementing string, pumping in a wiping latch-down plug so that it is held by the threads in the inner housing and forms a seal with the inside of the inner housing of the shoe and the ball valve forms a second seal with the second shoulder means.

BACKGROUND OF THE INVENTION

1. Field of the Invention

The present invention relates to a re-entry cementing shoe having a stab-type cementing pipe string receiver, latch threads for a latch plug, locating means and anti-rotation means for a sonar/TV guidance system, and a ball type valve for preventing reverse fluid flow where the ball housing has a conduit leading from the lower portion of the pocket to the outside of the shoe. A method of re-entering and cementing an underwater well or bore hole using a shoe adapted to allow easy entry of a sonar/TV guidance system through a cementing pipe string attached to the shoe, followed by the introduction of cement, the backward flow of which is checked both by a ball valve and a latch-down plug.

2. Description of the Prior Art

Deep underwater re-entry of an established oil or natural gas or exploratory hole on the ocean floor is an established procedure. A number of methods and apparatus have been developed to facilitate the procedure. One of the most cost-effective methods involves the use of sonar and/or TV camera guidance systems to help locate the hole. In general a string of pipe is lowered to within the vicinity of the hole, then a guidance system is lowered through the string of pipe so that the sensing devices are in position such that they can guide the string to and within the entrance of the hole. Once the string is in the hole the guidance system is withdrawn and normal operations can be carried on. Such general guidance systems and methods are described in U.S. Pat. No. 3,199,613 (issued Aug. 10, 1965) and U.S. Pat. No. 4,031,544 (issued June 21, 1977) which are incorporated herein. Other systems and methods are described in issues of *Ocean Industry* (August and June 1970) and in *Offshore* (November 1970) and are incorporated herein.

One of the problems associated with the re-entry of a well or bore hole with a cementing shoe is that while a system for preventing the reverse flow of cement is desired, the system must allow easy entry of the guidance system through the cementing pipe string and subsequent easy withdrawal. A flapper valve has been used but this has the problem that it may become fouled against the camera, or it may damage the camera as it passes through. A better and novel arrangement would be to have a ball valve assembly to prevent backflow. Such a valve could be easily moved out of the way by the entrance of the guidance system or could have a density such that it remains in a side pocket in water. Ball valve systems have been employed generally in pipe strings for example in U.S. Pat. Nos. 3,568,768, 2,825,412, 2,737,244, 3,332,497, 3,269,463, 3,584,645, 3,850,191 and 3,850,194. Well and/or cementing systems have employed ball valve systems for example, in U.S. Pat. Nos. 2,212,087, 2,320,670 and 3,616,850. Where these ball valve systems have pocket conduit systems to force the ball from the pocket to the seat, the conduit system opens into the bore of the piping systems.

None of the re-entry shoe systems use a ball valve, none of the ball valve systems use a pocket conduit means opening to space outside of the element, thus allowing draining outside of the shoe, lessening the chance for fouling, nor do any of the systems combine a ball valve with a latch-down plug system. Finally, none of the art specifies the use of a ball valve with a density between seawater and cement.

SUMMARY OF THE INVENTION

It is the object of the present invention to provide a re-entry cementing float shoe capable of receiving and positioning a sonar and/or TV guidance system through the cementing piping string of the shoe. It is also an object of this invention to provide a re-entry cementing float shoe and a method of using same where the inner portion of the shoe has a ball valve to prevent reverse flow.

It is an object of the present invention to provide a re-entry cementing float shoe and method of using same having a ball valve in combination with a system for receiving a latch-down plug.

It is a further object of the present invention to provide a re-entry cementing shoe and method of using same with a ball valve with a side pocket for said ball valve where the ball valve pocket has a conduit leading to the space outside of the shoe.

It is an object of the present invention to provide a re-entry cementing shoe with a ball valve where the ball valve has a density greater than sea water and less than cement.

It is the object of the present invention to provide an apparatus and method for re-entering and cementing an underwater well or hole using a guidance system that is lowered through the inner portion of the shoe where the reverse flow of the cement may be checked by a ball valve and a latch-down plug.

The invention provides for the lowering of a shoe attached to a casing, the equalization of pressure within and outside the casing so that a ball valve drops into the bottom of its pocket allowing the introduction of a sonar/TV guidance system, finding and entering a previously drilled hole, withdrawing the guidance system, lowering the string into place within the hole, introducing cement, controlling back flow with a ball valve, pumping down and securing a wiping pump-down latch plug and coincidently sealing the shoe to reverse flow through the use of a ball valve.

DESCRIPTION OF THE PREFERRED EMBODIMENTS

Figure 1:
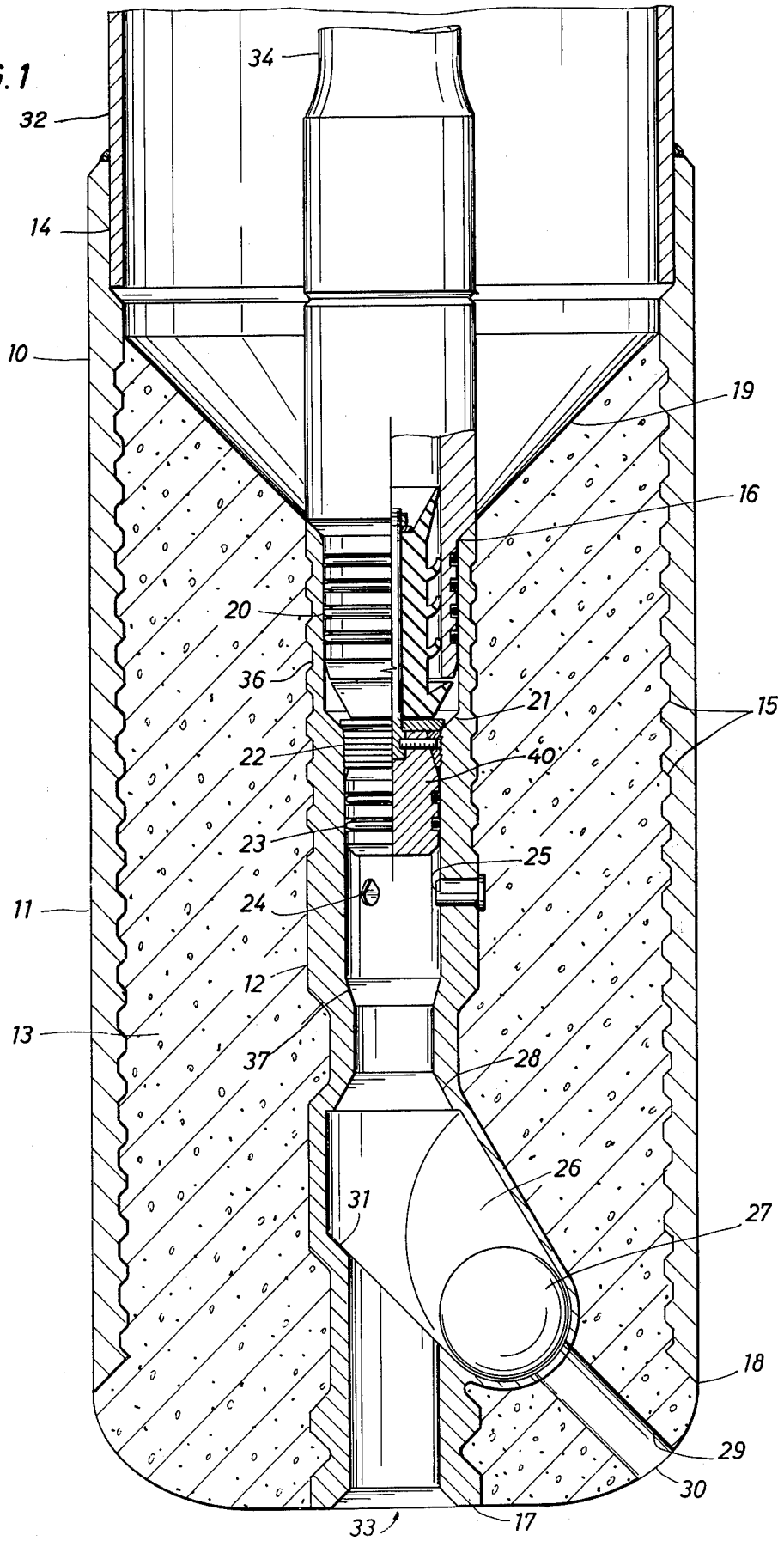
FIG. 1 is a view partly in elevation and partly in vertical section illustrating the re-entry float shoe for sonar/TV Tool with the ball valve in the side pocket made in accordance with the invention.

Referring to FIG. 1, the invention or shoe referred to generally as 10 comprises an outer cylindrical member (shoe or short casing), 11, and an inner cylindrical member, 12, in concentric spaced relationship forming an annular space partially filled with a cement core, 13. The inner top of the outer member is equipped with an attachment means, 14, suitable for attaching to a casing pipe string. This outer member attachment means could be either threads for attaching to the threaded outer portion of a casing string or means for welding the casing string to the inner surface of the outer member. The remainder of the inner surface of the outer member is equipped with grooves, 15, for securing the cement core to the outer member. The top of the inner member, 16, is positioned below the lower portion of the outer member attachment means, 14. While not absolutely necessary, the bottom of the inner member, 17, preferably extends below the bottom of the outer member, 18. The upper inner surface of the cement core, 19, is tapered downwardly from the inner surface of the outer member below the outer member attachment means, 14, preferably at a 45° angle, ending at the top of the inner member, 16, thereby forming a cone or funnel.

The top of the bore or inner surface of the inner member, 12, is equipped with an attachment means, 20, for receiving a stab-in cementing or drilling pipe string. Such a stab-type male member is usually equipped with O-ring seals. The bore of the inner member below the female stab-type attachment member, 20, is equipped with a first circular shoulder means, 21, sloping inwardly and downward, preferably at a 45° angle. Below the shoulder the inner surface of the inner member is equipped with threads, 22, and below the threads a smooth inner bore surface, 23, for receiving and locking in place a pump-down wiping latch plug usually equipped with O-ring seals. Below the surface area 23, the bore is equipped with a sonar/TV camera system seating means, 24, and a sonar/TV camera system orienting means, 25. Optionally, below the sonar/TV camera system seating means, 24, and orienting means, 25, there is an optional shoulder means, 37, sloping inwardly and downwardly.

Below the shoulder means, 37, and below the seating and orienting means, 24 and 25, there is a side pocket valve housing, 26, with a ball valve, 27, therein. The side pocket valve housing, 26, extends downwardly and outwardly at an angle from the bore of the inner member to a depth measured from the inner surface of the bore, at least equal to the diameter of the ball valve, 27. Below the shoulder means, 37, and the seating and/or orienting means, 24 and 25, and above the side pocket means, 26, there is a ball valve circular sealing/seating shoulder means, 28, sloping downwardly and outwardly at an angle such that when the ball valve, 27, is forced upward against the sealing/seating shoulder means, 28, it forms a seal or seat preventing reverse flow.

The ball valve, 27, is made of material such that its density is greater than the water in which it is to operate but less than the cement which is to be pumped through the shoe.

A conduit means, 29, forming a drain means extends from the lower end of the pocket housing, 26, in open communication with the space outside the shoe. The preferred embodiment is to have the end of the conduit means which opens to the space outside of the shoe, 30, opening at the bottom of the shoe through the cement in between the bottom of the inner member, 17, and bottom of the outer member, 18. The ball valve housing projects into the inner member bore to form a ball guide, 31, essentially a partial inwardly and downwardly sloping shoulder means which decreases the bore to a diameter less than that of the ball valve, 27, and directs the ball valve, 27, into the lower portion of the ball valve housing, 26.

Figure 2:
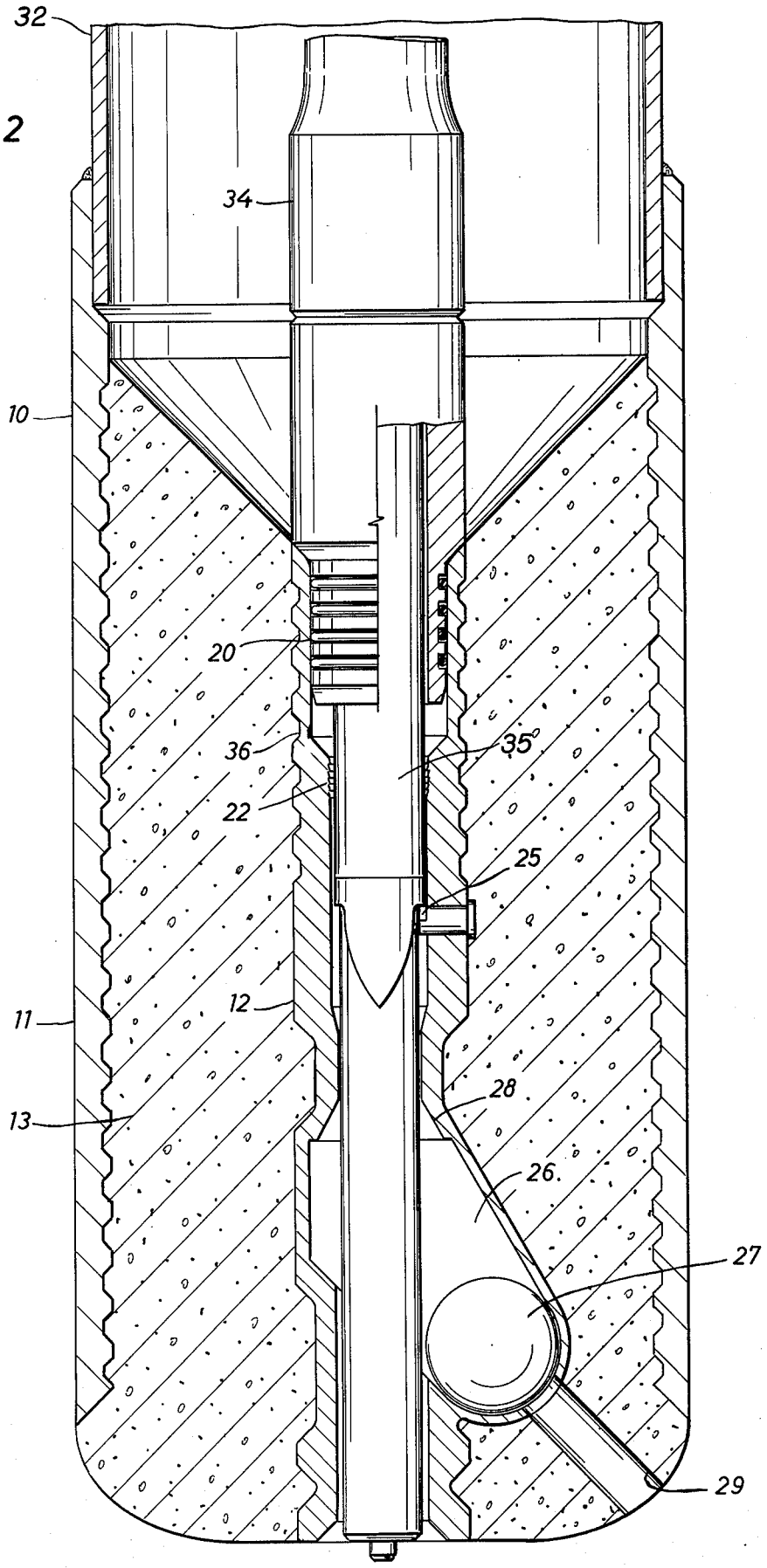
FIG. 2 is a view partly in elevation and partly in vertical section illustrating the invention with the sonar/TV Tool inserted therein.

FIG. 2 shows the re-entry float cement shoe assembly, 10, having been attached to a casing string, 32, at the casing attachment means, 14, of the outer cylindrical member, 11. While this casing attachment means, 14, is shown as a female member it need not be so and could be a male member. The outer cylindrical member, 11, surrounds an inner cylindrical member, 12, with a central bore, 33. The inner and outer members, 11 and 12, form an annular space which is filled with cement, 13. The outer member is preferably made of a nondrillable metal while the inner member is preferably made of a drillable material, preferably aluminum, plastic or cast iron. In a preferred embodiment the bottom of the inner member, 17, extends below the bottom of the outer member, 18. FIG. 2 shows the cementing drill pipe string, 34, having been stabbed into the female stab-type fitting, 20, of the inner member, 12. The sonar/TV camera, 35, is shown having been lowered into the bore, 33, in position to direct the shoe for re-entry.

The inner member, 12, is equipped with a plurality of grooves, 36, on its outer surface to anchor the inner member, 12, in the cement, 13, just as the outer member, 11, is equipped with a plurality of grooves, 15, on its inner surface to anchor it to the cement, 13.

The top of the inner member, 16, is below the bottom of the outer member casing attachment means, 14, and the cement core, 13, forms a cone or funnel, 19, sloping inwardly and downwardly starting from below the casing attachment means, 14, at the inner surface of the outer member, 11, and ending at the top of the inner member, 16. This cone guides the male stab-in portion of the cementing and/or drilling pipe string into the stab-type fitting, 20, of the inner member, 12. The bore of the inner member, 12, is equipped with a first shoulder means, 21, sloping inwardly and downwardly. Just below the shoulder means, 21, on the inner surface of the bore are a plurality of thread means, 22, preferably right-handed for attaching to a wiping pump-down latch plug. Below the thread means, 22, are a sonar/TV camera seating and anti-rotation means, 24 and 25.

Figure 3:
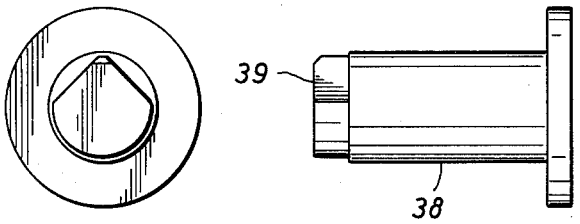
FIG. 3 is a view of a preferred sonar/TV guidance system seating and orientation means.

Preferred seating means, 24, and anti-rotation or orienting means, 25, are shown in FIG. 3. The camera seating and orientation means are the same means and are made of a plurality of lugs, 38, which penetrates the inner member, 12, with a projection, 39, which protrudes into the bore of the inner member, 12, about $\frac{1}{4}$ inch. The protruding member, 39, when viewed from the center of the bore has a profile where the bottom half is a semi-circle and the top half is a 90°/45°/45° triangle, the 90° angle forming the topmost part of the means, ie., a line perpendicular with the bore and passing along the lug would bisect the 90° angle and pass through the center of the semi-circle and the triangle. The base of the triangle and the top half of the semi-circle are contiguous and preferably 0.687 inches long.

In. FIG. 2 the ball valve, 27, is in the side pocket valve housing, 26, allowing the sonar/TV re-entry tool to pass through the bore of the inner member, 12. The sonar/TV camera tool has been seated and oriented by the means, 24 and 25, which have locked on the seating and orienting means of the sonar/TV camera tool.

Figure 4:
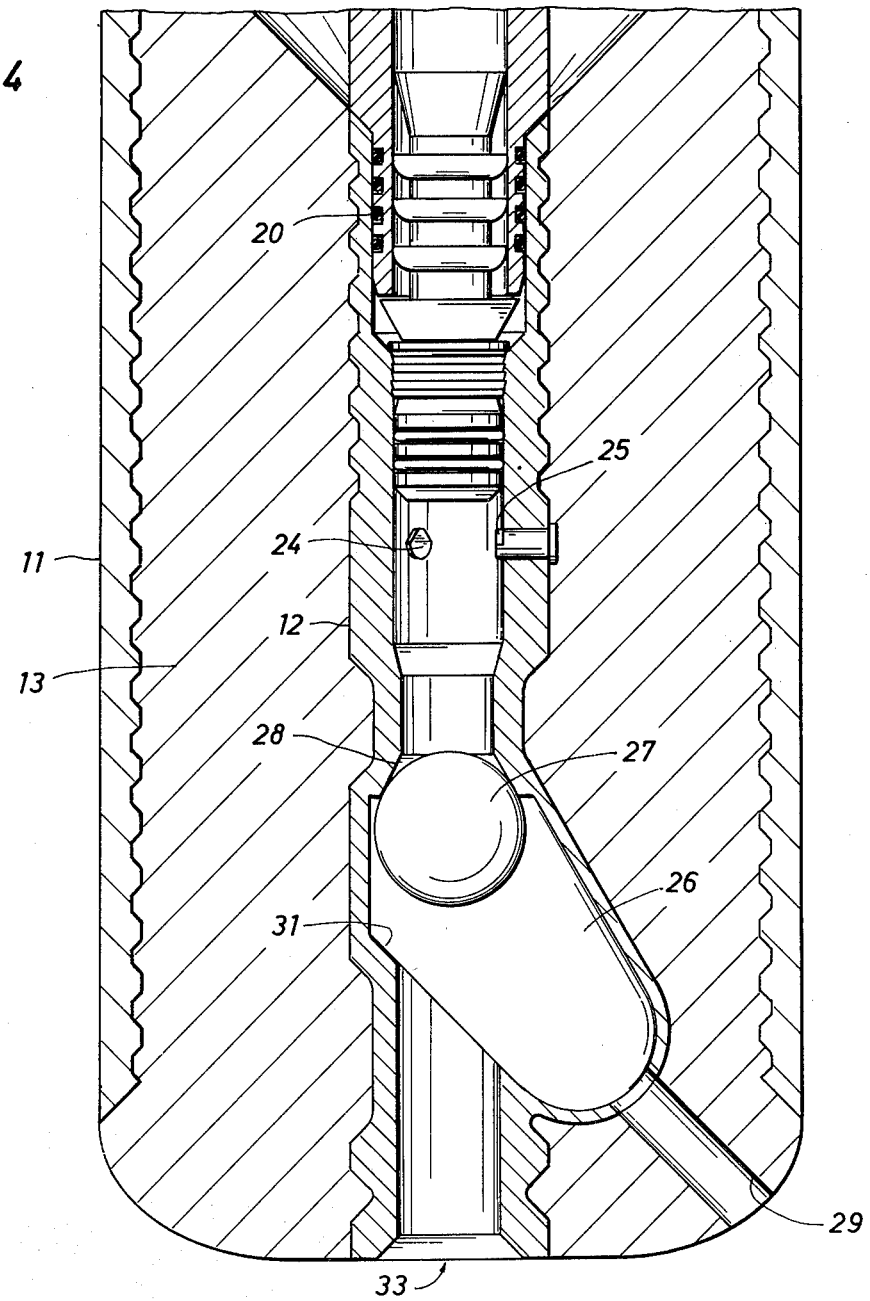
FIG. 4 is a view partly in elevation and partly in vertical section illustrating the invention with the ball valve in its sealing position with a pump-down latch plug in place.

FIG. 4 shows the invention, 10, after it has entered the well or hole, the sonar/TV camera tool has been removed, the shoe lowered into place, cement pumped into place and the pump-down latch plug, 40, introduced. As in the other figures, there is an outer cylindrical member, 11, and an inner cylindrical member, 12, the inner member being placed into the outer member thereby forming an annular space which is filled with cement, 13. The top inner surface of the outer member, 11, is equipped with a casing attachment means, 14. The top of the cement, 19, begins at the inner surface of the outer member below the attachment means, 14, and slopes inwardly and downwardly forming a cone, stopping at the top of the inner member, 16. Preferably the top of the inner member, 16, is sloped inwardly and downwardly to complete the cone.

The upper preferably 6-8/5 inches of the bore of the inner member, 12, forms a female stab-type fitting means, 20, with a bore diameter of preferably 4.94 inches. Below the fitting means, 20, there is a shoulder means, 21, which reduces the bore to preferably 3.375 inches. Immediately below the shoulder means, 21, are a plurality of threads, 22, extending preferably about 2 inches down the bore of the inner member, 12. The sonar/TV camera seating and orienting means, 24 and 25, project into the bore of the inner member, 12, below the threads, 22, preferably between about 21-5/32 and 21-21/32 inches from the end of the inner member, 17. Optionally, below the means, 24 and 25, there is an optional shoulder means, 37, which reduces the bore to 2.94 inches. This shoulder means, 37, while preferred is not absolutely necessary for the invention to function. Below the means, 24 and 25, and if one exists, below the shoulder means, 37, there is a shoulder seating and sealing means, 28, which increases the bore diameter to preferably 4.94 inches. In FIG. 4 a ball valve, 27, is seated against the means, 28, thus preventing the reverse flow of fluid. A side pocket ball valve housing, 26, communicates with the 4.94 inch bore, extends downwardly at an angle to a depth at least equal to the diameter of the ball valve, 26. A ball guiding shoulder means, 31, set at the same angle as the side pocket ball valve housing, 26, and forming part of the bottom of the housing, 26, reduces the bore of the inner member, 12, to 3.25 inches. A conduit means forming a drain means, 29, communicates with the bottom of the side pocket ball valve housing, 26, and the outside of the shoe, 10, preferably extending at the same angle as the housing, 26, through the cement, opening between the end of the outer member, 18, and the end of the inner member, 17.

The preferred method of using the invention involves attaching a casing pipe string, 32, to the attaching means, 14, lowering the shoe, 10, by increasing the length of the casing string to the desired length. When the desired casing pipe string is less than the depth of water over the well or hole to be re-entered, the shoe is lowered to the length of casing needed, then the drilling or cementing pipe string, 34, stabbed into the stab-type fitting, 20, and the shoe lowered further to the vicinity of the well head by increasing the drilling or cementing string. If the casing is longer than the depth of the water over the well then the shoe is lowered to the vicinity of the well by the casing and the cement or drill pipe string, 34, stabbed into the fitting, 20.

The sonar/TV tool is lowered into the drilling or cementing piping string. The ball valve, 27, is more dense than water, preferably more dense than sea water and less dense than the fluid, cement or mud, to be pumped down the well or hole. The density is between about 1.20 and about 1.40, preferably between about 1.20 and about 1.30. The ball valve, 27, may be in closed position up against this seating shoulder, 28, or in the housing, 26, depending on how carefully the shoe was lowered, i.e., depending on whether a water pressure differential was formed while lowering.

Once the shoe is in the vicinity of the hole to be re-entered, the sonar/TV camera is lowered into place on the seating means, 24, and orienting means, 25, of the shoe, 10. The ball valve, 27, remains out of the way or is moved out of the way easily by the sonar/TV camera tool into the side pocket ball valve housing, 26.

The shoe, 10, is positioned and lowered into the hole with the help of the sonar/TV camera tool and then the camera tool is withdrawn, the ball valve, 27, remains in the housing, out of the way, as the tool is withdrawn. The shoe, 10, is lowered into place by increasing the pipe(s) string. Once in place the desired amount of cement is pumped down the cementing pipe string, 34, through the bore, 33, and the conduit, 29, then a wiping pump-down latch plug is pumped down and it forms a seal with the bore directly below the threads, 22, and is held in place by the threads. The ball valve, 27, which is less dense than the cement in which it now finds itself floats up out of its pocket, helped by the backward flow of the cement through the conduit, 30, and the bore, 33, to form an additional seal at the shoulder sealing means, 28.

While the invention is described in terms of use with only cement, it should be recognized that the shoe could be advantageously used where further drilling was needed. In that case the density of the ball valve should be greater than the water in which it is used but less than the other liquids, drilling mud and cement, to be used in the hole. After entering the hole and withdrawing the TV/sonar guidance system, a drill is lowered into place, drilling is carried out, the drill removed and the cementing operation completed as described above.

While FIGS. 1, 2 and 4 have shown one preferred embodiment of the re-entry shoe, it is possible in another embodiment to switch the placement within the inner housing of the ball valve and its ball valve housing with the camera seating and orientating means. Thus, in another embodiment of the invention moving down the bore of the inner housing, one would find a first shoulder means sloping downwardly and inwardly, followed by a series of threads on the inner surface of the inner housing followed by a smooth surface for sealing with the pump-down latch plug just as shown in FIGS. 1, 2 and 4. Instead of placing the camera seating and orientating means above the ball valve housing, the next member would be the second shoulder means (sloping outwardly and downwardly) and forming a seating and sealing means for the ball valve and the top of the ball valve housing which would follow. Again the pocket of the ball valve housing would extend down and at an angle from the bore of the inner housing. The conduit would communicate outside of the shoe by communicating with the bottom of the pocket and passing through the cement core and through the outer housing, preferably at the same angle as the pocket projects from the inner housing bore. The camera seating and orientating means would be below the ball valve housing in the bore of the inner housing. This would require either an adjustment of the length of the shoe, the length of the camera or the position of that portion of the camera with with the camera seating and orientating means interact.

In FIGS. 1, 2 and 4 the top of the outer housing has been shown as having a female casing attachment means but in another embodiment of the invention this could also be a male attachment means. If it were a male attachment means then the top of the cement core which forms the funnel could be contiguous with the top of inner surface of the outer housing.

I claim as my invention:

1. A re-entry cementing float shoe comprising an inner cylindrical housing member and an outer cylindrical housing member in concentric spaced relationship forming an annular space therebetween with a cement core filling said annular space, the inner housing member has its top below the top of the outer housing member, the upper surface of the cement core forms a tapered funnel, sloping inwardly and downwardly, the bottom of the funnel ending at the top of the inner housing member and the top of the funnel ending at the inner surface of the outer housing member, the top of the outer housing member is equipped with a casing attachment means capable of attaching to a casing pipe string, the top of the inner surface of the inner housing member forms a female stab-type pipe string attachment means, below said stab-type attachment means within the inner housing member is a pump-down latch acceptor means forming part of the inner housing bore consisting of a shoulder means sloping inwardly and downwardly, followed by a plurality of threads, followed by a smooth section, the threads being capable of interacting and holding a pump-down latch plug and the smooth section being capable of sealingly contacting with a pump-down latch plug, below said pump-down latch plug means is a sonar/TV camera seating means and a sonar/TV camera anti-rotational means, also below said pump-down latch plug means is a valve means forming part of the inner housing bore consisting of a second shoulder means sloping outwardly and downwardly forming the top of a side-pocket ball valve housing having within it a ball valve, the side pocket extends downwardly and outwardly from the side of the inner housing member to a depth at least equal to the diameter of the ball valve, the side pocket is equipped with a conduit means forming a drain means extending from the bottom of the side pocket communicating at all times with the space outside of the shoe, the density of the ball valve being greater than water and less than the cement to be used with the shoe.

2. The float shoe of claim 1 where the valve means is below the sonar/TV camera seating means and anti-rotational means.

3. The float shoe of claim 2 where the conduit means communicates with the space outside of the shoe by extending from the bottom of the side pocket and through the bottom of the cement core, between the inner and outer housing members.

4. The float shoe of claim 3 where the casing attachment means is a female casing attachment means and the top of the cement core tapered funnel ending below the female casing attachment means at the inner surface of the outer housing member.

5. The float shoe of claim 4 where the plurality of threads forming part of the pump-down latch plug means are righthanded.

6. The float shoe of claim 5 where the inner housing member is made of drillable material.

7. The float shoe of claim 6 where the density of the ball valve is between about 1.20 and about 1.40.

8. A process of re-entering an underwater hole and cementing within the underwater hole with a re-entry cementing float shoe comprising an inner cylindrical housing member and an outer cylindrical housing member in concentric spaced relationship forming an annular space therebetween with a cement core filling said annular space, the inner housing member has its top below the top of the outer housing member, the upper surface of the cement core forms a tapered funnel, sloping inwardly and downwardly, the bottom of the funnel ending at the top of the inner housing member and the top of the funnel ending at the inner surface of the outer housing member, the top of the outer housing member is equipped with a casing attachment means capable of attaching to a casing pipe string, the top of the inner surface of the inner housing member forms a female stab-type pipe string attachment means, below said stab-type attachment means within the inner housing member is a pump-down latch acceptor means forming part of the inner housing bore consisting of a shoulder means sloping inwardly and downwardly, followed by a plurality of threads, followed by a smooth section, the threads being capable of interacting and holding a pump-down latch plug and the smooth section being capable of sealingly contacting with a pump-down latch plug, below said pump-down latch plug means is a sonar/TV camera seating means and a sonar/TV camera anti-rotational means, also below said pump-down latch plug means is a valve means forming part of the inner housing bore consisting of a second shoulder means sloping outwardly and downwardly forming the top of a side-pocket ball valve housing having within it a ball valve, the side pocket extends downwardly and outwardly from the side of the inner housing member to a depth at least equal to the diameter of the ball valve, the side pocket is equipped with a conduit means forming a drain means extending from the bottom of the side pocket communicating at all times with the space outside of the shoe, the density of the ball valve being greater than water and less than the cement to be used with the shoe consisting essentially of attaching said shoe via the casing attachment means to a casing pipe, lowering the shoe under water to the vicinity of the hole, stabbing a cementing pipe string into the female stab-type pipe string attachment means, positioning a sonar/TV camera guidance by lowering the guidance system through the cementing pipe string on to the sonar/TV camera seating means and anti-rotational means within the shoe, finding and entering the hole by moving the shoe in response to information received from the guidance system, withdrawing the guidance system, lowering the shoe within the hole to the desired dpeth by increasing the length of the pipe string, pumping in the desired amount of cement and checking the backward flow of cement by allowing the valve means to close and by pumping a pump-down latch plug down the cementing pipe string until threads on the latch plug have attached to the plurality of threads of the pumpdown latch plug acceptor means.

9. The process of claim 8 where the valve means of the shoe is below the sonar/TV camera seating means and anti-rotational means, the conduit means passes through the bottom of the cement core, between the inner and outer housing members, the casing attachment means being a female casing attachment means, the top of the tapered funnel ending below the casing attachment means at the innersurface of the outer housing member, the plurality of threads forming part of the pumpdown latch plug means are righthanded and the density of the ball valve is between about 1.20 and about 1.40.

* * * * *